United States Patent [19]

Hargreaves

[11] Patent Number: 4,530,535

[45] Date of Patent: Jul. 23, 1985

[54] CARGO HOOK

[75] Inventor: John E. Hargreaves, Coquitlam, Canada

[73] Assignee: Cranston Machinery Company, Inc., Oak Grove, Oreg.

[21] Appl. No.: 535,898

[22] Filed: Sep. 26, 1983

[51] Int. Cl.[3] ..... B66C 1/34

[52] U.S. Cl. ..... 294/82.24

[58] Field of Search ..... 294/83 R, 75, 78 R, 294/82 R, 83 A, 83 AB; 24/230.5 R

[56] References Cited

U.S. PATENT DOCUMENTS 3,964,777 6/1976 Lindquist ..... 294/83 R 4,095,833 6/1978 Lewis ..... 294/83 R

*Primary Examiner*—James B. Marbert

*Attorney, Agent, or Firm*—Lee R. Schermerhorn

[57] ABSTRACT

A horizontal load carrying pin is rotatable on a horizontal pivot and has a free end supported on a saddle on a latch arm which may be withdrawn to release the load. Upon release of the load a counterweight on the opposite end of the pin returns the pin to horizontal position. The latch arm is spring opened and held in closed position by a pawl which may be released by a remote controlled fluid pressure cylinder and piston or by a manually operated lever in the housing of the hook. The load carrying pin is of generally cylindrical shape to carry flat web type slings as well as steel rings.

18 Claims, 3 Drawing Figures

CARGO HOOK

This invention relates to a cargo hook for use on cranes and other lifting apparatus wherein heavy loads are lifted and moved, as for example by slings around the loads.

BACKGROUND OF THE INVENTION

Most prior devices for this purpose are too complicated and expensive to be practical and most are not designed for very heavy loads. The conventional devices have an excessive number of moving parts to provide release in different ways as may be desired. This makes them expensive to manufacture and keep in good working order. Failure of a load hook may result in expensive loss of time in a large loading or unloading operation. Also, most prior load hooks are not suitable for use with the now common flat web slings.

SUMMARY OF THE INVENTION

The present load hook is of very simple and rugged construction designed to lift and move heavy loads. There are relatively few moving parts to assemble and manufacture and keep in good working order.

In the present construction a horizontal load carrying pin is rotatable on a horizontal pivot and has a free end supported on a saddle on a latch arm which may be withdrawn to release the load. Upon release of the load a counterweight on the opposite end of the pin returns the pin to horizontal position.

The latch arm is spring opened and held in closed position by a pawl which may be released by a remote controlled fluid pressure cylinder and piston or by a manually operated lever in the housing of the hook or, if desired, by a pull cord or electrical release. The load carrying pin is of generally cylindrical shape to carry flat web type slings as well as steel rings.

The invention will be better understood and additional object and advantages will become apparent from the following description of the preferred embodiment illustrated in the accompanying drawings. Various changes may be made in the details of construction and arrangement of parts and certain features may be used without others. All such modifications within the scope of the appended claims are included in the invention.

DESCRIPTION OF THE PREFERRED EMBODIMENT

Figure 1:
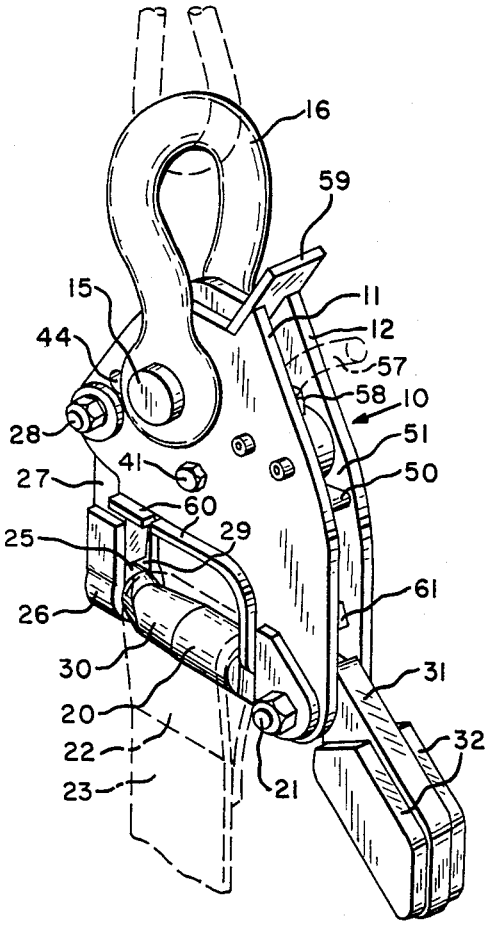
FIG. 1 is an isometric view of the present cargo hook.

The housing 10 comprises a pair of spaced apart face plates 11 and 12 which enclose most of the operating mechanism. In the upper part of the housing, opening 13 in the faces plates 11 and 12 contains a half bearing 14 for supporting the housing on a pin 15 in a clevis 16. Clevis 16 is suspended by a cable or chain from a crane or other lifting device, normally putting the face plates 11 and 12 in vertical positions as shown.

The load to be lifted and moved by the crane is suspended from a releasable horizontal load pin 20 which is pivotally mounted at one end on a horizontal bolt 21 in the face plates 11 and 12. Load pin 20 is adapted to receive a loop or eye 22 on one end of a flat web sling 23 on one side of the load to be lifted of carried. Sling 23 passes under the load and has a similar eye or loop 22 on its other end supported by a similar load hook on the opposite side of the load.

Load pin 20 has a free end 25 which in load carrying position is supported on a saddle 26 on the lower end of a latch arm 27 which is pivotally mounted at its upper end on a bolt 28 in the face plates 11 and 12. In the present embodiment the end portion 25 of the pin 20 is cylindrical and the saddle 26 has a semi-cylindrical supporting surface in the lower portion of an opening 29 in the lower end of latch arm 27.

Load pin 20 may be cylindrical throughout its length between pivot 21 and its free end 25 but in the present embodiment at least a portion of the length of the pin adjacent its saddle supported free end portion 25 has a slight conical taper in the region 30. If the load is supported by a steel ring or a clevis loop similar to the present clevis 16 the tapered portion 30 of the pin will tend to shift the load supporting ring or clevis loop away from the end of the pin supported by pivot bolt 21 and toward the free end 25 of the pin supported by saddle 26, which is desirable.

On the opposite side of pivot bolt 21 extension 31 of the pin 20 projects out from between face plates 11 and 12 to provide a handle for manual manipulation. Handle 31 carries a pair of counter weights 32 to return the pin back to horizontal position after release of the load sling 23 when the housing 10 is in vertical position as shown.

Above its pivot bolt 28 the upper end of latch arm 27 has an abutment surface 35 which is engaged by an abutment surface 36 on one end of a pawl 40 which is pivotally mounted on a bolt 41 in the face plates 11 and 12. In an upward release movement limited by stop 42 the pawl abutment surface 36 disengages latch abutment surface 35 and a second pawl abutment surface 43 engages latch arm abutment surface 35 to limit the clockwise release movement of latch arm 27. Openings 44 in face plates 11 and 12 provide for observation of the abutment surfaces 35, 36 and 43.

Latch arm 27 is constantly urged toward release position by a compression spring 45. One end of spring 45 bears against a stationary guide block 46 between face plates 11 and 12 and the opposite end of the spring holds an end of a pin 47 seated in an recess 48 in latch arm 27.

On the opposite side of pivot bolt 41 and the pawl 40 has a manual manipulating arm 50 enclosed between face plates 11 and 12 so that it cannot be engaged and moved unintentionally by some exterior object. The space between face plate 11 and 12 provides an access opening as indicated at 51 in FIG. 1 for insertion of an operator's finger for manual manipulation of arm 50.

Pawl arm 50 is constantly urged in counter-clockwise rotation by a compression spring 52 confined between a stationary spring seat 53 and the underside of handle arm 50. Latch arm 27 is released by remote control by a piston 55 in cylinder 56 supplied by a gas pressure hose 57 at cylinder. connection 58. Piston 55 bears against the upper side of pawl release arm 50. A guard plate 59 projects upward from housing 10 between hose 57 and clevis 16. Connection 58 is protected by face plates 11 and 12.

Above the load pin 20 the space between face plates 11 and 12 is closed by guard plates 60. Above the pivot bolt 21 there is a spacer block and handle stop 62 between the face plates. The half bearing 14, stop 42, guide block 46, spring seat 53, guard plates 58, 60 and spacing block 61 are all welded to the face plates 11 and 12 to maintain the face plates in parallel spaced apart relation as shown.

Figure 3:
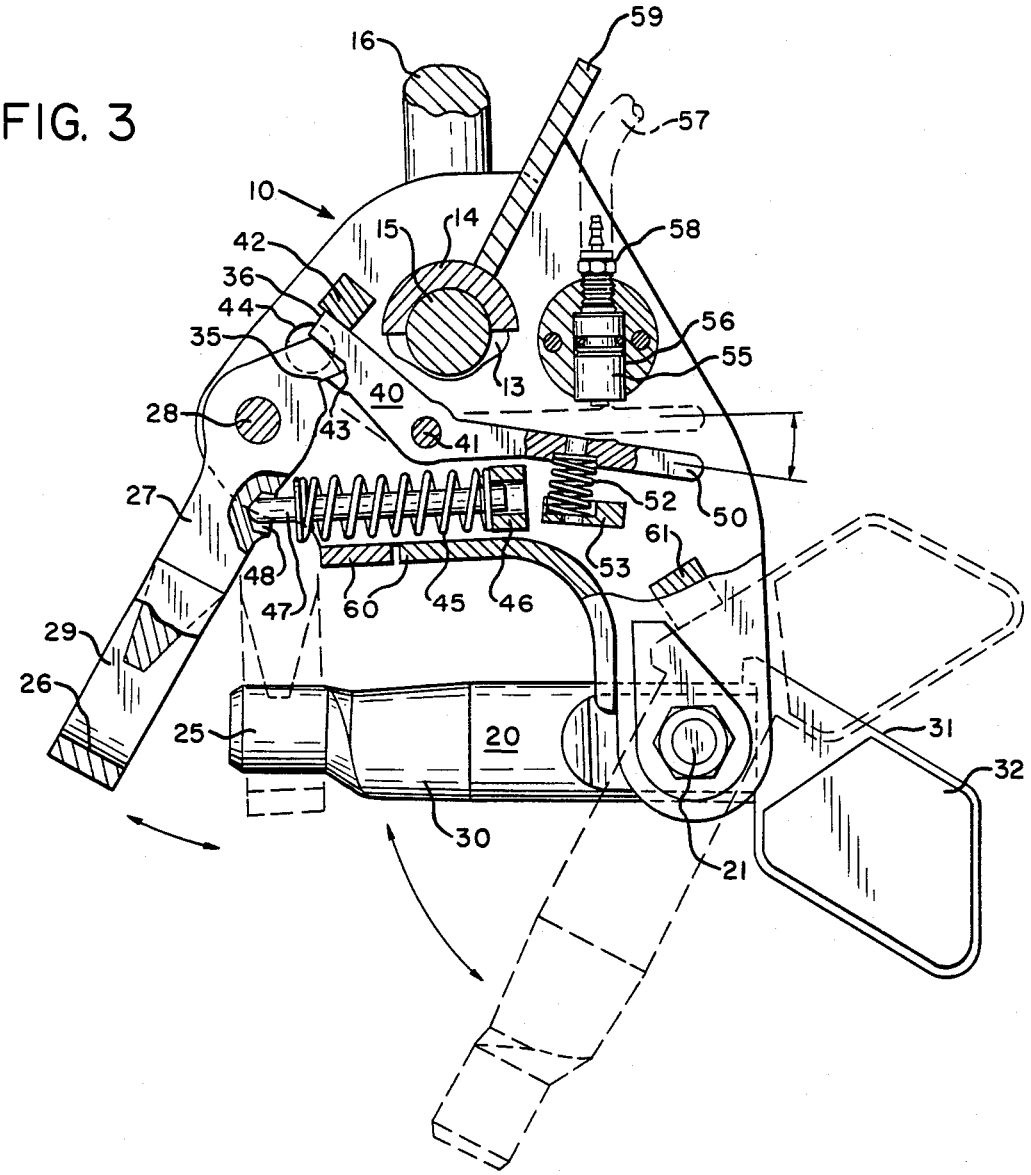
FIG. 3 is a view similar in FIG. 2 with the parts shown in solid lines in positions existing after release of a load.

With the cargo hook hanging in vertical position after release of a load, the parts assume the positions shown in solid lines in FIG. 3. After the sling has slipped off load pin 20 momentarily in broken line position, counterweights 32 return the load pin to horizontal position. Spring 45 holds latch arm 27 at the limit of its clockwise rotation with its abutment surface 35 engaged by the abutment surface 43 on pawl 40, this engagement holding pawl 40 in actuated position.

Figure 2:
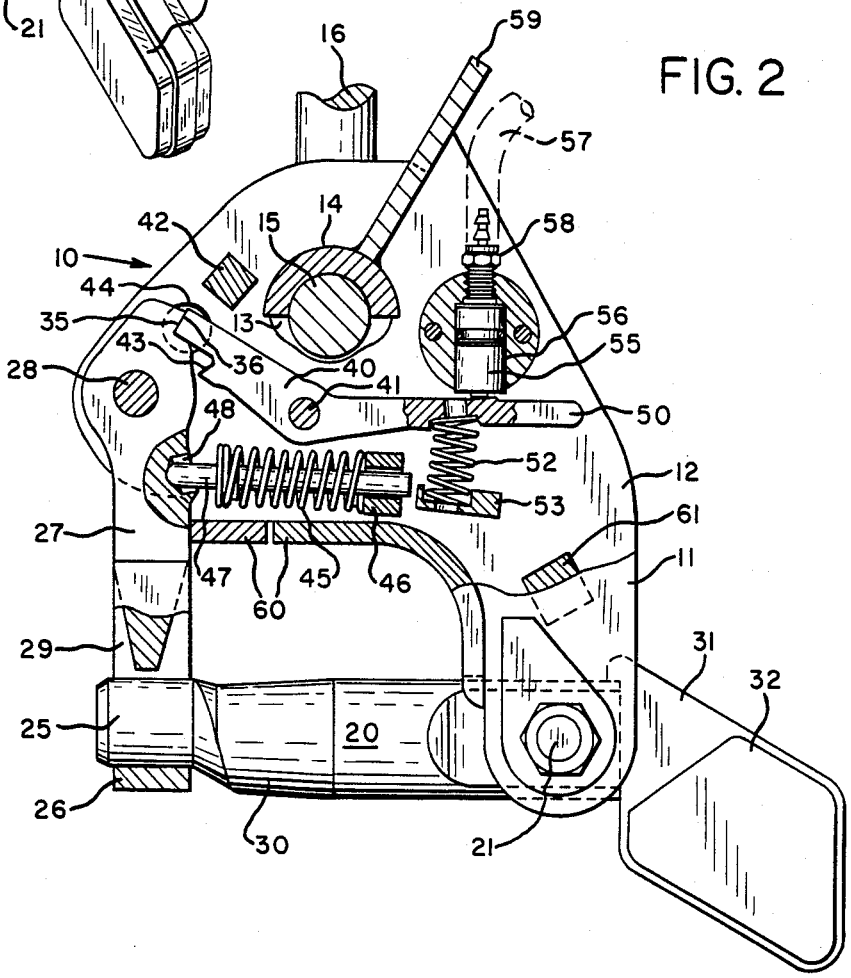
FIG. 2 is an elevation view with the front face plate of the housing removed and parts shown in section, the parts being shown in lifting positions.

A sling loop or metal ring may then be placed over the free end of load pin 20 and retained thereon by manually rotating latch arm 27 counter-clockwise to enclose end portion 25 of the load pin in opening 29 in the latch arm. This counter-clockwise rotation of latch arm 27 releases pawl 40 to rotate counter-clockwise and engage pawl abutment surface 36 with latch arm abutment surface 35 as shown in FIG. 2. The hook and load are then lifted by the crane and moved to a desired position.

The load is released by remote control piston 55 or manually by pawl handle arm 50. Clockwise rotation of pawl 40 disengages pawl abutment surface 36 from latch arm abutment surface 35 allowing spring 45 to rotate the latch arm clockwise and disengage supporting saddle 26 from the end portion 25 of the load arm.

If there is any tension on the sling 23 the load pin 20 will be rotated counterclockwise to its broken line position in FIG. 3 to release the sling. If there is no tension on the sling the load pin 20 may be rotated to release position manually by handle 31 or by operating the crane to lift housing 10. This returns the parts to their solid line positions in FIG. 3 if housing 10 is hanging in vertical position so that counterweights 32 can return load pin 20 to its horizontal position. The cargo hook is then ready to receive another load.

A safety feature is that spring 45 does not apply sufficient force against latch arm 27 to release load pin 20 when sling 23 is carrying a load. The latch arm will release the load pin only after the load has been set down and the only weight on the load pin is that of the sling in slack condition.

What is claimed is:

1. A cargo hook comprising a housing, suspension means for said housing in an upper portion of said housing, a load support pin mounted for vertical movement on a horizontal pivot in one side of a lower portion of said housing, a vertical latch arm mounted at its upper end on a horizontal pivot in the opposite side of said housing, a saddle on the lower end of said latch arm movable into engagement with a free end of said pin to support said pin in horizontal position, means for swinging the lower end of said latch arm away from said free end of said pin to disengage said sadle from said pin and allow said pin to pivot downward on said first horizontal pivot, a pawl arranged to hold said latch arm in a closed position supporting said pin, and means to release said pawl allowing said latch arm to release said pin.

2. A cargo hook as defined in claim 1, said saddle being a supporting surface in an opening in said latch arm.

3. A cargo hook as defined in claim 1, said pin being pivoted downward by a load thereon when said latch arm is opened, and means for returning said pin to horizontal position when said load is disengaged from said pin.

4. A cargo hook as defined in claim 3, said returning means comprising a counterweight on said pin on the opposite side of said pivot from said free end.

5. A cargo hook as defined in claim 4, said counterweight projecting out of said housing to provide a handle for said pin.

6. A cargo hook as defined in claim 1, said means for opening said latch arm comprising a spring.

7. A cargo hook as defined in claim 1, said means for releasing said pawl comprising a cylinder and piston.

8. A cargo hook as defined in claim 1, said means for releasing said pawl comprising a manually actuatable arm on said pawl.

9. A cargo hook as defined in claim 8, said pawl being contained within said housing and said housing having a finger opening for said manual actuation of said pawl.

10. A cargo hook as defined in claim 1, said pawl having a first stop abutment engaging said latch arm in one position of the pawl to hold said latch arm in said closed position and having a second stop abutment engaging said latch arm in a second position of the pawl to limit the opening movement of the latch arm.

11. A cargo hook as defined in claim 10 including a spring urging said pawl toward said one position.

12. A cargo hook as defined in claim 1, said suspension means comprising an opening through said housing and a half bearing in the upper side of said opening.

13. A cargo hook as defined in claim 1, the load supporting portion of said pin being circular in cross section and said free end of the pin being cylindrical.

14. A cargo hook as defined in claim 13, a portion of the load supporting length of said pin having a slight taper toward its free end.

15. A cargo hook as defined in claim 1, said housing comprising a pair of spaced apart face plates, an arm of said pawl for operating the pawl, said pawl including said arm being contained within the space between said face plates, and said space between the face plates being open for finger access adjacent said pawl arm for manual operation of the pawl arm.

16. A cargo hook as defined in claim 15 including a cylinder and piston contained in said space between the face plates for remote operation of the pawl arm.

17. A cargo hook as defined in claim 16 including a fluid pressure connection on said cylinder in a protected position between the face plates.

18. A cargo hook as defined in claim 17 including an outstanding guard plate on said housing between said suspension means and said fluid pressure connection on said cylinder.

* * * * *